US009084922B2

(12) United States Patent
DiMichele, Jr.

(10) Patent No.: US 9,084,922 B2
(45) Date of Patent: Jul. 21, 2015

(54) APPARATUS AND METHOD FOR TRAINING A THROWING TECHNIQUE

(76) Inventor: Frank Lawrence DiMichele, Jr., Norristown, PA (US)

( * ) Notice: Subject to any disclaimer, the term of this patent is extended or adjusted under 35 U.S.C. 154(b) by 311 days.

(21) Appl. No.: 13/531,563

(22) Filed: Jun. 24, 2012

(65) Prior Publication Data

US 2013/0344997 A1 Dec. 26, 2013

(51) Int. Cl.

| | |
|---|---|
| ***A63B 69/00*** | (2006.01) |
| *A63B 43/00* | (2006.01) |
| *A63B 43/02* | (2006.01) |

(52) U.S. Cl.

CPC ..... *A63B 69/0002* (2013.01); *A63B 69/0086* (2013.01); *A63B 43/007* (2013.01); *A63B 43/02* (2013.01); *A63B 69/0088* (2013.01); *A63B 2069/0006* (2013.01)

(58) Field of Classification Search

CPC ..... A63B 69/0002; A63B 69/0073; A63B 69/0079; A63B 69/0084; A63B 69/0086; A63B 69/088; A63B 69/0091; A63B 2069/0006; A63B 2069/0008; A63B 2069/0011; A63B 43/007; A63B 2243/0004; A63B 2243/0008; A63B 67/20

USPC ..... 473/423, 424, 425, 427, 429, 430, 451, 473/458

See application file for complete search history.

(56) References Cited

U.S. PATENT DOCUMENTS

| | | | | |
|---|---|---|---|---|
| 3,152,803 | A * | 10/1964 | Sain, Jr. | 473/424 |
| 3,601,398 | A * | 8/1971 | Brochman | 473/424 |
| 3,731,925 | A * | 5/1973 | Caldwell | 473/424 |
| 3,997,159 | A * | 12/1976 | Malhas | 473/464 |
| 4,577,864 | A * | 3/1986 | Aldrich | 473/424 |
| 4,846,471 | A | 7/1989 | Haysom | |
| 4,846,472 | A * | 7/1989 | Terza | 473/424 |
| 4,989,867 | A * | 2/1991 | Herrick | 473/429 |
| 5,092,588 | A | 3/1992 | Deluca | |
| 5,250,016 | A | 10/1993 | Higgins | |
| 5,433,435 | A * | 7/1995 | Bourie | 473/424 |
| 5,709,619 | A * | 1/1998 | D'Emidio | 473/424 |
| 5,830,091 | A | 11/1998 | Romanick | |
| 5,957,789 | A * | 9/1999 | Ainscough et al. | 473/423 |
| 6,007,500 | A | 12/1999 | Quintinskie, Jr. | |
| 6,024,660 | A | 2/2000 | Romanick | |
| 6,837,808 | B1 * | 1/2005 | Hatch | 473/424 |
| 6,884,187 | B2 | 4/2005 | Cataldi, Jr. et al. | |
| 7,115,051 | B2 * | 10/2006 | Hansberry | 473/423 |
| 7,374,502 | B2 | 5/2008 | Comello, Jr. | |
| 7,691,013 | B2 * | 4/2010 | Emerson | 473/459 |

(Continued)

*Primary Examiner* — Mark Graham

(74) *Attorney, Agent, or Firm* — Law Offices of Robert F. Zielinski LLC

(57) ABSTRACT

The present invention is an apparatus and a method for training a throwing technique. The apparatus includes an elongated member, a weighted element, and a flexible joining means. The apparatus may further include a placement means. The elongated member includes a lower end, an upper end, and a body portion. The weighted element has an attachment point, and is movable from a starting position to an ending position. The flexible joining means includes a first end, a second end, and an intermediate portion. The flexible joining means has a predetermined length, is secured about upper end of elongated member, has second end that is secured at attachment point of weighted element, and is movable from a starting position to an ending position. The method includes the steps of: placing the apparatus, balancing on pitching leg, taking an extended stride or lunge toward target, and explosively rotating upper torso rotationally downward.

25 Claims, 6 Drawing Sheets

(56) References Cited

U.S. PATENT DOCUMENTS

| | | | | |
|---|---|---|---|---|
| 7,699,724 | B1 | 4/2010 | Derisse | |
| 7,955,197 | B2 | 6/2011 | Roudybush | |
| 8,574,102 | B1 * | 11/2013 | Russell | 473/425 |
| 2003/0220173 | A1 | 11/2003 | Parker | |
| 2006/0003854 | A1 * | 1/2006 | Hansberry | 473/423 |
| 2006/0014597 | A1 * | 1/2006 | Cantu et al. | 473/422 |
| 2006/0035729 | A1 * | 2/2006 | Wang | 473/417 |
| 2007/0105663 | A1 * | 5/2007 | Farnsworth et al. | 473/422 |
| 2009/0062084 | A1 | 3/2009 | Gamboa et al. | |

* cited by examiner

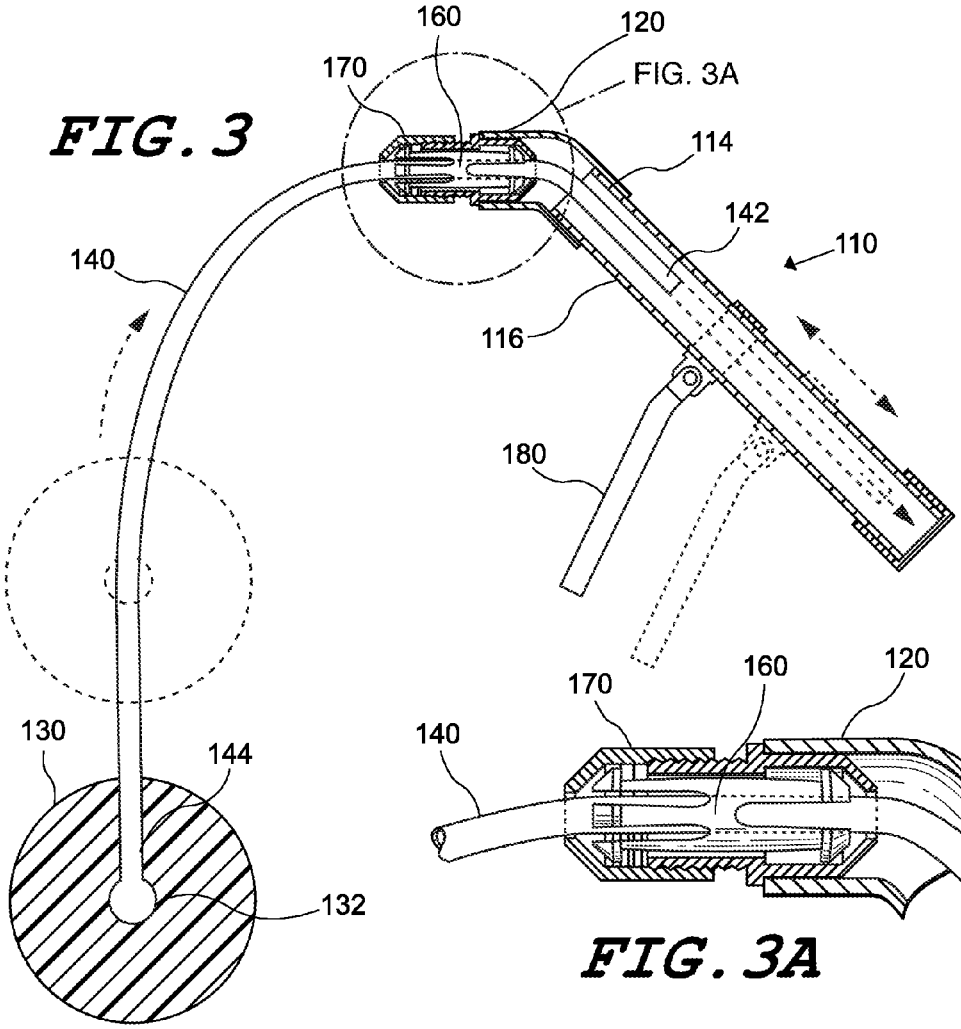
FIG. 3
FIG. 3A
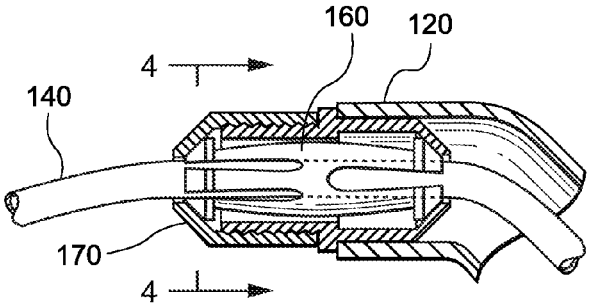
FIG. 3B
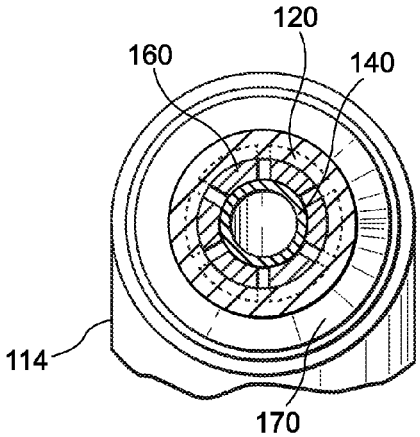
FIG. 4

FIG. 5
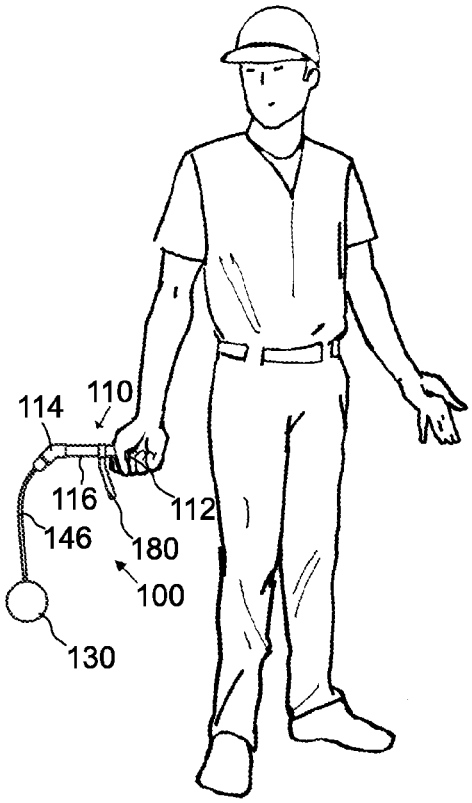
FIG. 6
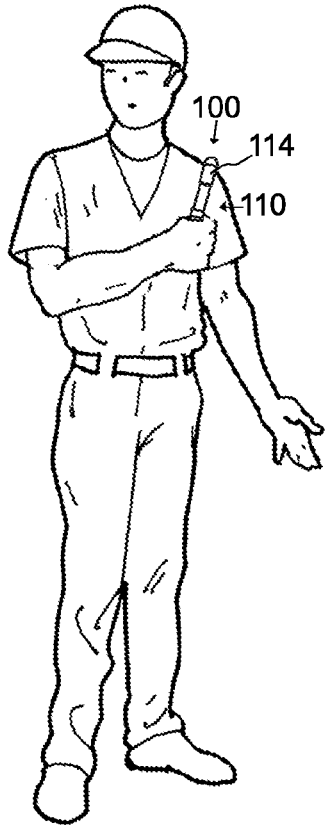
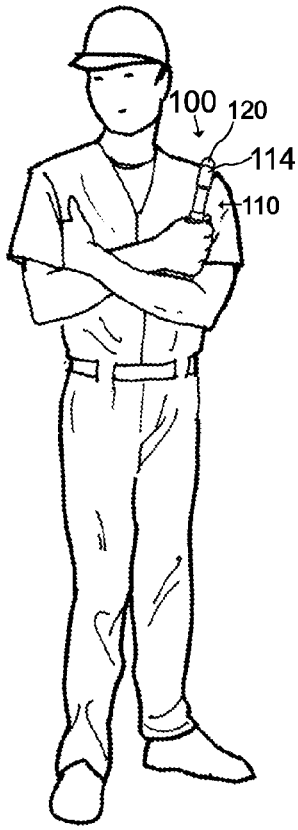
FIG. 7

FIG. 12
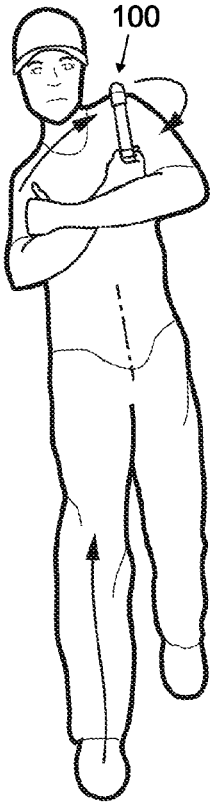
FIG. 13
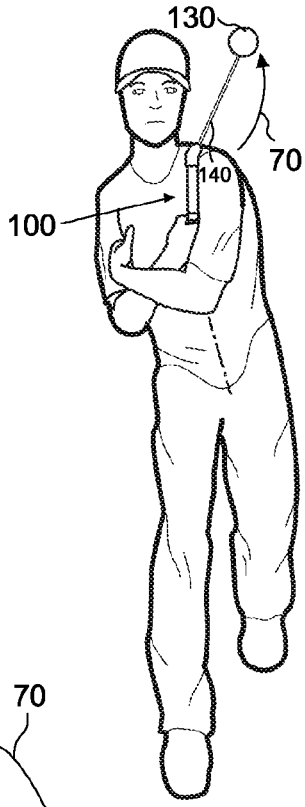
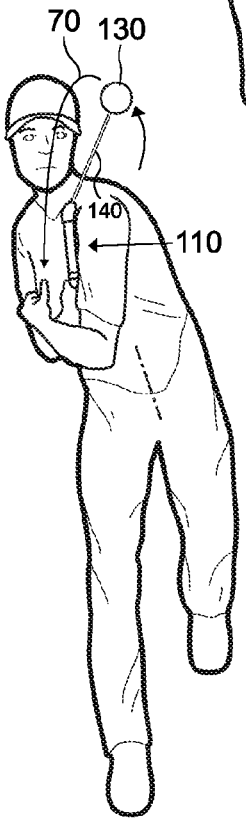
FIG. 14
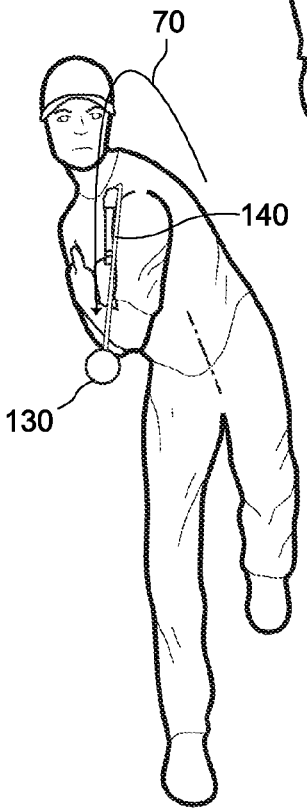
FIG. 15

APPARATUS AND METHOD FOR TRAINING A THROWING TECHNIQUE

FIELD OF THE INVENTION

This invention relates to the field of athletic training and rehabilitating equipment and methodology. More specifically, the present invention relates to an apparatus and a method for safely teaching and practicing proper throwing technique for children and adults.

BACKGROUND

Many popular sports, including but not limited to baseball, involve throwing a ball or other article. Often, it is desirable to throw a ball repeatedly and consistently at a high velocity. When a ball is thrown repeatedly and forcefully, such as by a baseball pitcher attempting to throw a pitch of high velocity, improper throwing technique can cause a number of problems, such as but not limited to, decreased velocity, lack of control, inconsistency in delivery, and arm injury. In many cases, arm injuries caused by improper throwing techniques result in the pitcher being placed on a medical leave or the disabled list until healed, and in some cases such arm injuries may end the pitcher's career prematurely. And when a pitcher has been injured and has been healing, he must re-train pitching to regain his pre-injury pitching capabilities, yet the need to re-train must be balanced against the need to avoid re-injuring the pitcher. As a result, an arm injury caused by improper throwing technique can lead to many weeks on the bench or disable list (i.e. not being able to play), which may have negative consequences for the pitcher's career and financial well-being. Moreover, in teaching and training throwing or pitching technique, there is an emphasis on strengthening the arm and focusing on arm and wrist motion; this focus, combined with the intense competition among professional and nonprofessional athletes, leads to a high incidence of injuries to the throwing arm, shoulder, elbow, wrist, and their supporting muscle tissues, in particular.

The terms "pitching" and "pitcher" are used throughout this application but they are expressly used to mean an example of "throwing" and "thrower," respectively, and are not meant to be limiting. The term "forward" is defined as toward the target. The term "downward" is defined as toward the ground in the direction of gravity. The term "pitching side" or "pitching" used as an adjective is defined as "left" if the pitcher is training to throw the ball with the left hand and "right" if the pitcher is training to throw the ball with the right hand. The term "non-pitching side" or "non-pitching" used as an adjective is defined as right if the "pitching side" is left, and left if the "pitching side" is right. The term "arm" is defined as the entire arm, including the shoulder, elbow, wrist, hand, or any part of combination of parts thereof, and should not be construed as limiting.

Proper throwing or pitching technique involves a kinetic chain of motion originating in the pitcher's feet, traveling up the legs and through the body, and culminating in the forward rotation of the body as the ball leaves the pitcher's hand. The kinetic chain of motion in the pitcher's body culminates in the pitcher's throwing arm being propelled forward in an arc and results in the desired "whip" motion of the wrist and hand just as the ball is released. This kinetic chain of motion is best learned and practiced with the pitching arm and hand immobilized in order to focus on the proper body movement which is crucial to proper throwing or pitching technique. Learning, practicing and using proper pitching technique increases power and accuracy while significantly reducing risk of injury. With proper pitching technique, the power and speed of the pitch originates not in the arm or wrist but at the feet and body and is transmitted through the body to the shoulders, arm, wrist and hand, thus greatly reducing the stress and load placed on the pitching arm.

Devices, apparatuses and methods to teach pitching techniques are known. Devices and apparatuses for the rehabilitation or therapy of an injured pitching arm also are known. Information relevant to attempts to address these problems can be found in U.S. Pat. Nos. and Patent Application Publication Nos. U.S. Pat. No. 7,955,197 to Roudybush; 2003/0220173 to Parker; 2009/0062084 to Gamboa et al.; U.S. Pat. No. 7,699,724 to Derisse; U.S. Pat. No. 7,374,502 to Comello, Jr.; U.S. Pat. No. 6,884,187 to Cataldo, Jr. et al.; U.S. Pat. No. 6,024,660 to Romanick; U.S. Pat. No. 6,007,500 to Quitinskie, Jr.; U.S. Pat. No. 5,830,091 to Romanick; U.S. Pat. No. 5,250,016 to Higgins; U.S. Pat. No. 5,092,588 to DeLuca; U.S. Pat. No. 4,846,471 to Haysom; 2004/0033849 to Socci; 2004/0033850 to Socci; and U.S. Pat. No. 5,423,730 to Hirsch. However, each of these references suffers from one or more of the following disadvantages: technique and operation of the device or apparatus is focused on movement of the arm and wrist only and does not address or teach body alignment, stability, leverage, direction, momentum, balance, or rotation of the torso; technique and operation of the device or apparatus is focused on teaching and practicing the arc of the pitching arm and/or the "whip" motion of the arm and wrist associated with a powerful pitch; technique and operation of the device or apparatus is focused on developing muscle memory in the arm, wrist and hand; the device or apparatus is sized for average sized adult males and is not adjustable for children or for smaller adults; or use of the device or apparatus requires the arm to perform the motions of throwing a ball and therefore is not appropriate for athletes recovering from arm injuries. None of the references teaches proper throwing technique, focusing on the kinetic chain of energy originating in the feet and utilizing balance, momentum, direction, leverage and rotation to transfer kinetic energy to the throwing arm, which can be used by children or adults regardless of whether they are healing from an arm injury.

For the foregoing reasons, there is a need for an apparatus and a method for teaching and practicing proper throwing technique, focusing on the kinetic chain of energy originating in the feet and utilizing balance, momentum, direction, leverage and rotation to funnel and transfer kinetic energy to the throwing arm, which can be used by children or adults regardless of whether they are healing from an arm injury.

SUMMARY

The present invention is directed to an apparatus and a method for teaching and practicing proper throwing technique, focusing on the kinetic chain of energy originating in the feet and utilizing balance, momentum, direction, leverage and rotation to funnel and transfer kinetic energy to the throwing arm, which can be used by children or adults regardless of whether they are healing from an arm injury.

Apparatus: An apparatus having features of the present invention comprises an elongated member, a weighted element, and a flexible joining means. The apparatus may further comprise a placement means.

As an embodiment and non-limiting example, the elongated member includes a lower end, an upper end, and a body portion extending between said lower end and said upper end. The upper end may be an open end that can be adapted to fasten a removably affixed end cap with a through-hole permitting the flexible joining means to pass through and into the preferably hollow space of the elongated member when affixed. The elongated member may have an engagement portion extending rearward and preferably slightly upward from the upper end, wherein the engagement portion, upper end and body portion define an elbow-like configuration and an angle with respect to a longitudinal axis of the elongated member.

The weighted element has an attachment point, and is movable from a starting position to an ending position with respect to the elongated member as a result of a training exercise of a user when the apparatus is in use. The weighted element may be made of or encased in a soft rubber, fabric or plastic such as urethane foam (foam rubber), Neoprene, or sponge, to cushion the blow when it strikes the user's arm or body during use; and can include a substantially spherical shape, such as a baseball-sized sphere. Alternatively, the weighted element can include a shape, size and weight simulating the shape, size and weight of the article desired to be thrown.

The flexible joining means includes a first end, a second end, and an intermediate portion extending between the first end and second end. The flexible joining means has a predetermined length, is secured about the upper end of the elongated member, has the second end that is secured at the attachment point of the weighted element, and is movable from a starting position to an ending position with respect to the first elongated member as a result of the training exercise of the user when the apparatus is in use. The flexible joining means can be made of any flexible tubing, rope or cord of rubber, plastic or fibers, such as bungee cord, surgical latex or plastic tubing.

The flexible joining means may be secured about the upper end of the elongated member by an adjustable securement means to adjustably secure the flexible joining means to the first elongated member while permitting the length of the flexible joining means to be varied as desired. The adjustable securement means may include an expansion fitting and the removably secured end cap, wherein the expansion fitting is adapted to fit securely inside the engagement portion and to adjustably secure the flexible joining means to the elongated member while permitting the length of the flexible joining means to be varied as desired.

The placement means can include an elongated tubular member adjustably affixed to the elongated member of the apparatus generally perpendicular to the elongated member's longitudinal axis.

The angle defined by the engagement portion, upper end of the elongated member, and body portion of the elongated member may be generally about 135 degrees. The placement means preferably can be adjustably angled toward the closed end for greater comfort when the placement means is placed preferably in the armpit of the user as described below.

Method: A preferred method of training proper throwing technique using the preferred embodiment of the invention follows. The method generally comprises the steps of placing the apparatus against the body of a user in the starting position, balancing on the pitching-side leg, taking an extended stride or lunge toward the target, and explosively rotating the upper torso rotationally downward and toward the non-pitching side with the pivot point being at or around the navel. In the placement step, the elongated member of the apparatus is held with the non-pitching hand near the closed end and the elongated member is placed vertically generally parallel to and against the user's torso so that the placement means is held in the user's pitching-side armpit, the angled upper end is placed in contact with the top of the pitching-side shoulder on or around the acromion, and the flexible joining means is placed over the user's pitching-side shoulder and the weighted element suspended therefrom hangs near or about the user's pitching-side shoulder blade.

The user keeps his non-pitching forearm crossed over the chest as he continues to hold the apparatus in place during the training exercise, and the user's pitching forearm preferably is crossed over his non-pitching forearm for the purpose of keeping the arms close to the torso and out of the way. The user's pitching hand may be placed in the non-pitching armpit, leaving the thumb near or about the non-pitching shoulder. The user's elbows should be pointed generally down and relaxed.

In the balance step, from a stance facing the target with both feet on the ground approximately shoulder-width apart, the user initiates the kinetic chain of an overhand throw in the direction of the target by lifting his non-pitching knee, shifting all weight to the pitching-side leg, while turning his body on its longitudinal axis toward the pitching side of his body while keeping his eyes on the target, so that his non-pitching deltoid faces the target and his non-pitching shoulder is brought toward his chin.

In the lunge step, as the user prepares to bring the non-pitching foot down he pushes the non-pitching hip forward in an extended forward stride or lunge. As the extended stride progresses forward, the user's hips rotate toward the target while the user maintains the sideways position of the upper torso. As the non-pitching foot comes down and touches the ground (a point hereinafter referred to as "foot touch"), the user gradually lifts his non-pitching elbow up in the opposite direction of the ground, causing the plane of the shoulders to tilt toward the pitching side and away from the target, causing additional weight to be balanced on the pitching-side foot. The arms preferably are maintained across the chest, the torso maintains its sideways position relative to the target and the weighted element hangs from the flexible joining means substantially near the user's pitching-side shoulder blade.

In the explosive rotation step, once the extended forward stride is completed and the non-pitching foot is planted (a point hereinafter referred to as "foot plant"), the user then, in one sudden, explosive motion originating from the non-pitching elbow, upper arm and shoulder, pivots his torso rotationally around the navel toward the non-pitching side and down, driving his non-pitching elbow into his non-pitching side near or around the Iliac crest. The sudden downward rotation rockets the pitching shoulder forward and causes the kinetic energy accumulated in the non-pitching shoulder to be transferred along the shoulder line to the pitching shoulder and into the flexible joining means. The flexible joining means then acts as the throwing arm, transferring the kinetic energy from the body's kinetic chain to the weighted element, thus causing the weighted element to be whipped forward in front of the user's body.

In proper throwing technique, the kinetic chain starts from the feet and travels up along the body, eventually being funneled to the pitching shoulder, which then funnels the kinetic energy into the pitching arm and expels it along the fingers and off the fingertips during a pitch.

When training according to the preferred method of the invention, the kinetic energy starts from the feet and travels up along the body, eventually being funneled to the throwing shoulder, but rather than funneling into the arm and fingers, as with a pitch, instead the flexible joining means of the apparatus acts as the throwing arm and continues the transfer of kinetic energy through the joining means and into the weighted element, whipping the weighted element forward as in an overhand throw.

When proper body alignment, balance, momentum, rotation and coordination is achieved, the weighted element, which is tethered to the elongated member by way of the flexible joining means, strikes the user's non-pitching arm substantially near the elbow. By keeping the pitching forearm and pitching hand relatively immobile and passive, the user is able to learn, focus on and practice proper body position, balance, coordination and transfer of kinetic energy without the distraction of or risk of injury to the throwing arm or hand. The use of the apparatus as a substitute for the user's throwing arm and ball highlights the key principle that in proper throwing technique, the throwing arm is merely reacting to the kinetic chain of motion, not initiating the motion culminating in the throw, and that the power of the throw comes from the feet, legs and body, not from the arm, wrist or hand.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 3 is a right side, vertical cross-sectional view of the embodiment shown in FIG. 1, showing the end cap partially engaged and showing adjustable positions in phantom;

FIGS. 3A and 3B are right side, vertical cross-sectional views of an inset detail of the embodiment shown in FIG. 3, showing the end cap in partially engaged and fully engaged positions, respectively;

FIG. 4 is a front, horizontal cross-sectional view of the end cap section, taken along line 4-4 in FIG. 3B, of the embodiment shown in FIG. 1; and FIGS. 5-16 are front isometric views of the embodiment of FIG. 1 in use according to a method of the invention, where FIGS. 5-7 show the placement step, FIG. 8 shows the balance step, FIGS. 9-10 show the lunge step, and FIGS. 11-16 show the explosive rotation step.

DETAILED DESCRIPTION OF THE PREFERRED EMBODIMENTS

Figure 1:
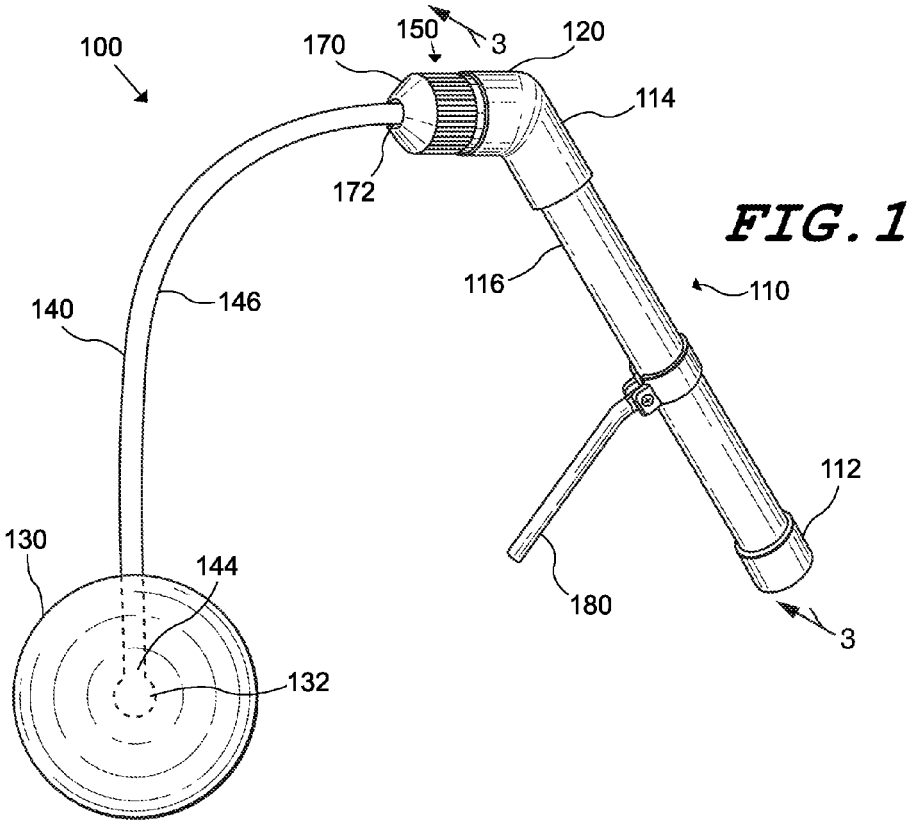
FIG. 1 is a perspective, right side view of an embodiment of an apparatus for training a throwing technique of the present invention.

The present invention relates to an apparatus 100 and a method for safely teaching and practicing proper throwing technique for children and adults. The training apparatus 100 may be used by baseball pitchers and other users who are involved in sports or activities involving overhand throwing, such as javelin and lacrosse.

Referring to FIGS. 1-4, one version of the training apparatus 100 comprises an elongated member 110, a weighted element 130, and a flexible joining means 140, wherein the elongated member 110 is adapted to be held in place against the user's torso during use, and wherein the flexible joining means 140 has a first end 142, a second end 144 and a predetermined length, and wherein the first end 142 of the joining means 140 is secured to the elongated member 110 and the second end 144 of the joining means 140 is secured to the weighted element 130. The training apparatus 100 may further comprise a placement means 180.

Figure 2:
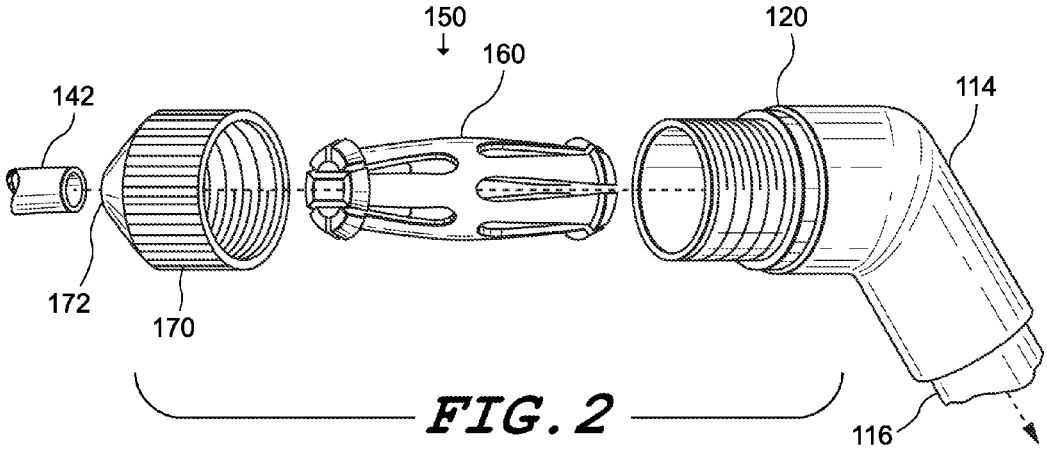
FIG. 2 is a right side exploded plan view of the embodiment shown in FIG. 1.
Figure 8:
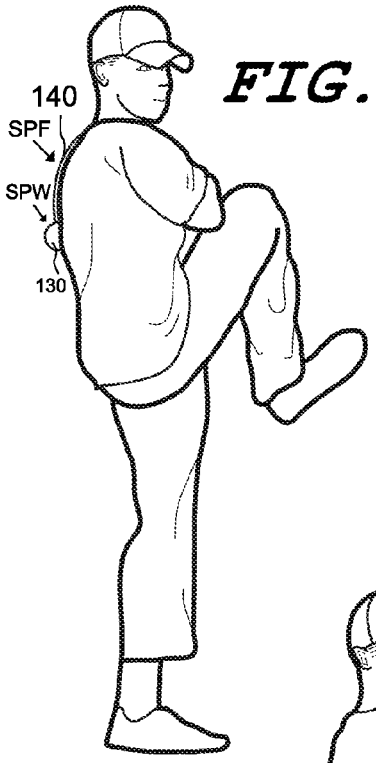
Figure 16:
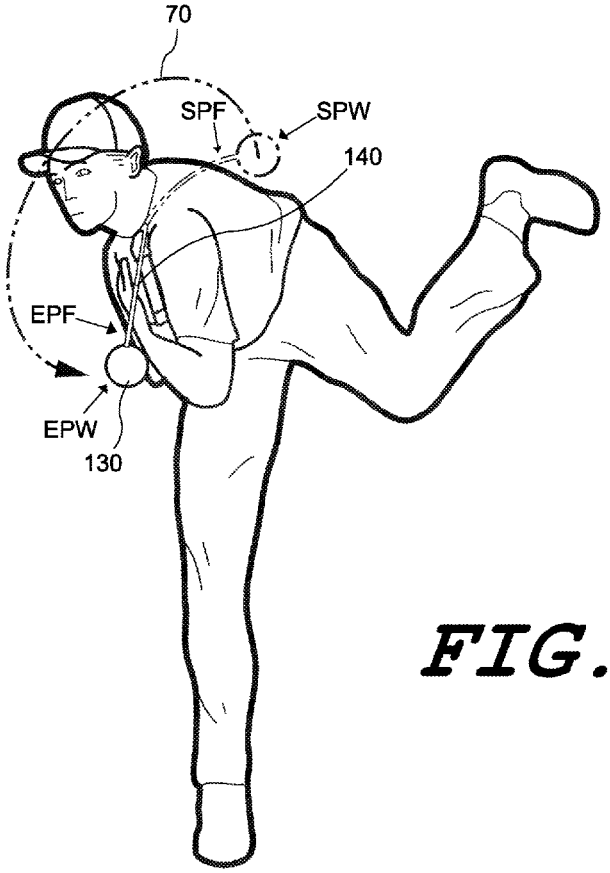

As shown in FIG. 1, the training apparatus 100 preferably comprises an elongated member 110 with a lower end 112, an upper end 114, a body portion 116 extending between the lower end 112 and the upper end 114, and a longitudinal axis; a weighted element 130 having an attachment point 132, wherein the weighted element 130 is movable from a starting position SPW, shown in FIG. 8, to an ending position EPW, shown in FIG. 16, with respect to the elongated member 110 as a result of a training exercise of a user when the apparatus 100 is in use; and a flexible joining means 140 comprising a first end 142, shown in FIGS. 2-3, a second end 144, and an intermediate portion 146 extending between the first end 142 and the second end 144, wherein the flexible joining means 140 has a predetermined length, is secured about the upper end 114 of the elongated member 110, is secured at a second end 144 at the attachment point 132 of the weighted element 130, and is movable from a starting position SPF to an ending position EPF with respect to the elongated member 110 as a result of the training exercise of the user when the apparatus 100 is in use. The elongated member 110 and weighted element 130 may be substantially opposite one another when the flexible joining means 140 is in the starting position SPF.

Referring to FIGS. 1-2, the elongated member 110 may be hollow. The lower end 112 of the elongated member 110 may be closed, while the upper end 114 of the elongated member 110 is preferably open. Also, the elongated member 110 may have an engagement portion 120 extending rearward and slightly upward from the upper end 114 of the elongated member 110, wherein the engagement portion 120, upper end 114 and body portion 116 define an elbow-like configuration and an angle with respect to the longitudinal axis of the elongated member 110. The engagement portion 120 preferably engages with the first end 142 of the flexible joining means 140. The flexible joining means 140 may be secured about the upper end 114 of the elongated member 110 by an adjustable securement means 150 to adjustably secure the flexible joining means 140 to the elongated member 110 while permitting the length of the flexible joining means 140 to be varied as desired. The adjustable securement means 150 may comprise an expansion fitting 160 and a removably secured end cap 170. The expansion fitting 160 may be adapted to fit securely inside the engagement portion 120 and to adjustably secure the flexible joining means 140 to the elongated member 110 while permitting the length of the flexible joining means 140 to be varied as desired. The removably secured end cap 170 may have a through-hole 172 permitting the flexible joining means 140 to pass through and into the elongated member 110.

As best shown in FIGS. 1-3, the angle defined by the engagement portion 120, upper end 114 and body portion 116 with respect to the longitudinal axis may be about 135 degrees. The attachment point 132 of the weighted element 130 to the flexible joining means 140 may be substantially centered within the weighted element 130.

The weighted element 130 may have a spherical shape. The weighted element 130 may have a weight similar to a weight of an article desired to be thrown. It is obvious to one of ordinary skill in the art that the weighted element 130 may have other shapes and/or weights that allows the training apparatus 100 to be an effective training tool. The weighted element 130 may be made of rubber, plastic, leather, cloth material, and any combination thereof, to cushion the blow when it strikes the user's arm or body during use. Alternatively, the weighted element 130 may be made of a hard material encased in rubber, plastic, leather, cloth, batting or wadding, and any combination thereof.

The flexible joining means 140 may be made of any flexible tubing, rope or cord of rubber, plastic or fibers, such as bungee cord, surgical latex or plastic tubing.

As best shown in FIGS. 1, 3 and 5, the training apparatus 100 may further include a placement means 180 secured to the elongated member 110, wherein the placement means 180 is adapted for being preferably positioned under the armpit of a user when in use. The placement means 180 may be a second elongated member adjustably secured to the first elongated member 110, generally perpendicular to the longitudinal axis of the first elongated member 110. The second elongated member 180 may be hollow, and may be adjustably securable to the first elongated member 110 along the first elongated member's longitudinal axis for the purpose of accommodating users of various sizes. The length of the first elongated member 110 from its angled upper end 114 to the top of the placement means 180 should be adjusted prior to use to approximately the length from the user's acromion to the user's armpit measured along the front of the user's torso.

A "first" arm, hand, shoulder, side, leg, or foot is defined as the arm, hand, shoulder, side, leg, or foot on the user's non-throwing side, referred to above as "non-pitching." A "second" arm, hand, shoulder, side, leg, or foot is defined as the arm, hand, shoulder, side, leg, or foot on the user's throwing side, referred to above as "pitching." Therefore, by way of example, in a left-handed pitcher, the "first" arm is the non-pitching or right arm and the "second" arm is the pitching or left arm.

Figure 9:
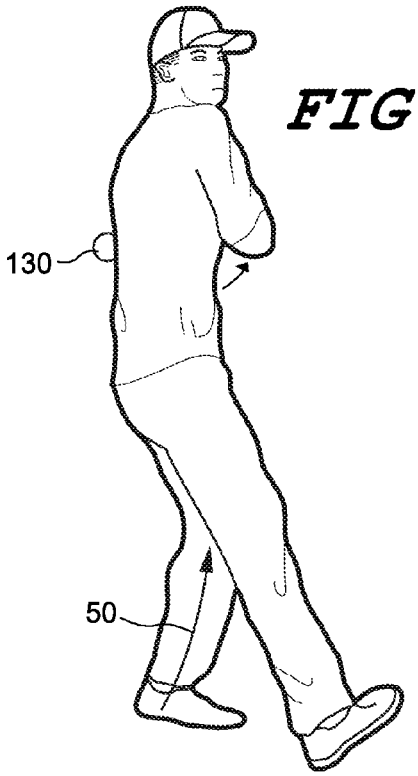
Figure 10:
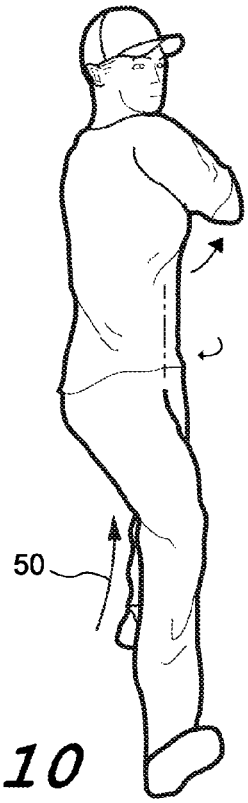
Figure 11:
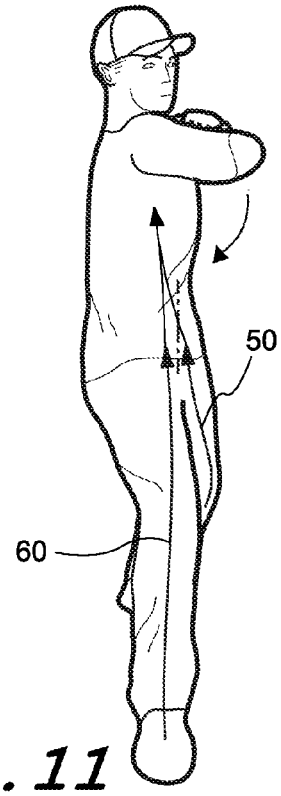

A preferred method for training a throwing technique comprises the steps of: (1) placing the apparatus 100 (as described above) against the body of a user in the starting position; (2) balancing on the pitching leg; (3) taking an extended stride or lunge toward the target; and (4) explosively rotating the upper torso rotationally downward, wherein (1) the placement step, as shown in FIGS. 5-7, comprises the steps of:

(a) As shown in FIG. 5, holding the elongated member 110, toward the lower end 112 of the elongated member 110, of training apparatus 100 in a first hand of the user by the user, wherein the apparatus 100 comprises the elongated member 110, a weighted element 130 having an attachment point 132 (shown in FIGS. 1 and 3), and a flexible joining means 140 having a first end 142 (shown in FIGS. 2-3), a second end 144 (shown in FIGS. 1 and 3), and an intermediate portion 146 extending between the first end 142 and the second end 144, wherein the elongated member 110 comprises the lower end 112, an upper end 114, a body portion 116 extending between the lower end 112 and the upper end 114, and a longitudinal axis, wherein the weighted element 130 is movable from a starting position SPW, shown in FIG. 6, 7 or 8, to an ending position EPW, shown in FIG. 16, with respect to the elongated member 110 as a result of a training exercise of a user when the apparatus 100 is in use, and wherein the flexible joining means 140 has a predetermined length, is secured about the upper end 114 of the elongated member 110, with a second end 144 of the flexible joining means 140 secured at the attachment point 132 of the weighted element 130, and wherein the flexible joining means 140 is movable from a starting position SPF to an ending position EPF with respect to the elongated member 110 as a result of the training exercise of the user when the apparatus 100 is in use, (b) As shown in FIG. 6, placing the elongated member 110 vertically generally parallel to and against the user's torso so that the placement means 180 is held in the user's second armpit, the angled upper end 114 of the elongated member 110 is placed in contact with the top of the second shoulder on or around the acromion, and the flexible joining means 140 is placed over the user's second shoulder so that the weighted element 130 attached thereto hangs about the user's second shoulder blade; and keeping the first forearm crossed over the chest as the user continues to hold the apparatus 100 in place during the training exercise, and (c) As shown in FIG. 7, crossing the second forearm over the first forearm and the second hand in the first armpit, leaving the thumb near or about the second shoulder and the elbows pointed generally down toward the ground and relaxed, wherein (2) the balancing step comprises, as shown in FIG. 8, from a stance facing the target with both feet on the ground approximately shoulder width apart, initiating the kinetic chain of an overhand throw in the direction of the target by lifting the first knee, shifting the weight to the second leg, while rotating the body on its longitudinal axis in the direction toward the second side of the body while keeping the eyes on the target, so that the first deltoid faces the target and the first shoulder is brought toward the chin, wherein (3) the lunge step comprises the steps of:

(a) As shown in FIG. 9, as the user prepares to bring the first foot down, pushing the first hip forward in an extended stride or lunge in the direction of the target while tilting the plane of the shoulders away from the ground on the first side, so that the first shoulder is further from the ground than the second shoulder, causing kinetic energy 50 to build in and travel up the second leg, (b) As shown in FIG. 10, as the extended stride progresses forward, allowing the hips to rotate toward the target while maintaining the sideways position of the upper torso, and (c) As the first foot touches the ground, i.e. at or just before "foot touch," lifting the first elbow away from the direction of the ground to increase the tilt of the shoulders to or near its maximum tilted position, that is with the first shoulder as far from the ground and the second shoulder as close to the ground as reasonably possible without losing balance and without releasing the sideways position of the upper torso, thereby maximizing the potential kinetic energy accumulated in the upper torso. At foot touch, the resistance caused by the first foot's contact with the ground travels up the first leg while the kinetic energy, or forward momentum, travels up the second leg. At foot plant, shown in FIG. 11, the forward momentum, or kinetic energy 50, meets the resistance 60 traveling up the first leg in or near the user's lower torso near the navel and is funneled upward into the upper torso, which remains in its sideways position with the first deltoid facing the target and the first shoulder tilted away from the ground, and wherein (4) the explosive rotation step, as shown in FIGS. 11-16, at foot plant and in one sudden, explosive motion originating from the first elbow, upper arm and shoulder, pivoting the torso rotationally around the navel toward the first side and down, driving the first elbow into the first side near or around the first Iliac crest. The sudden rotation of the torso as described causes the kinetic energy accumulated in the torso and first shoulder to be transferred along the shoulder line from the first shoulder to the second shoulder and into the flexible joining means, which in turn transfers the kinetic energy from the body's kinetic chain to the weighted element 130, causing the weighted element 130 to be whipped forward in front of the user's body.

The potential kinetic energy generated and funneled into the torso in the balancing step and lunge step is transferred through the body and into the apparatus 100 and is released in the explosive rotation step when the sudden downward rotation of the torso propels the second shoulder forward and rotationally downward, causing the flexible joining means 140 to act as the second arm and continue the transfer of kinetic energy through the joining means 140 and into the weighted element 130, causing it 130 to be propelled forward toward the target in an arc 70 as if it were a ball being thrown and the flexible joining means 140 were the throwing arm. The use of the apparatus 100 as a substitute for the user's throwing arm and ball highlights the key principle that in proper throwing technique, the throwing arm is reacting to the kinetic chain of motion, not initiating the motion of the throw. When proper body balance, momentum and coordination are achieved, the weighted element 130, tethered to the elongated member 110 by the flexible joining means 140, strikes the user's first arm about the elbow or the second hand, as shown in FIG. 16.

The steps of the method may be altered according to the needs of a user who is recovering from an arm injury. For example, alternatively, in the placement step, the second arm can be left passive along the second side so that the second elbow remains unbent. Alternatively, in the placement step, the first arm can be left passive along the first side so that the first elbow remains unbent. Alternatively, in the placement step, both arms may be left passive or may be placed in different configurations according to the needs of the particular user.

The length of the flexible joining means 140 may be altered, from a minimum length to a maximum length, according to the degree of difficulty desired by the user. In general, a longer flexible joining means 140 requires greater force and thus is more difficult to use relative to a shorter flexible joining means 140. A flexible joining element 140 adjustable from 12 inches to 20 inches (measured on the embodiment shown in FIG. 1 from the attachment point 132 to the end cap 170) is preferred, providing an adequate range of difficulty for most users. A user may begin training exercises with the apparatus 100 adjusted to provide a shorter-length flexible joining means 140 and may increase the length of the flexible joining means 140 as his skill and strength improves.

Alternatively, a version of the apparatus 100 may incorporate a speed-measuring means (not shown), such as a speedometer, on or near the weighted element 130 for the purpose of measuring the speed of the "pitch" and thereby track the user's progress through training.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An apparatus for training a throwing technique, said apparatus comprising:

a first elongated hollow member comprising a lower end, an upper end, and a body portion extending between said lower end and said upper end, wherein said first elongated member comprises an engagement portion extending rearward from said upper end of said first elongated member, wherein said engagement portion, said upper end and said body portion define an elbow-like configuration and an angle, and further wherein the elongated member is adapted to be held in place against a user's torso during use;

a weighted element, said weighted element having an attachment point, wherein said weighted element is movable from a starting position to an ending position with respect to said first elongated member as a result of a training exercise of a user when said apparatus is in use; and a flexible joining means comprising a first end, a second end, and an intermediate portion extending between said first end and said second end, wherein said flexible joining means has a predetermined length and wherein said flexible joining means is secured about said upper end of said first elongated member by an adjustable securement means to adjustably secure said flexible joining means to said first elongated member while permitting said length of said flexible joining means to be varied as desired, and wherein said engagement portion engages with said first end of said flexible joining means; and wherein said second end of said flexible joining means is secured at said attachment point of said weighted element, wherein said adjustable securement means comprises an expansion fitting and a removably secured end cap, wherein said expansion fitting is adapted to fit securely inside said engagement portion and to adjustably secure said flexible joining means to said first elongated member while permitting said length of said flexible joining means to be varied as desired, and wherein said removably secured end cap comprises a through-hole permitting said flexible joining means to pass through and into said first elongated member, and wherein said flexible joining means is movable from a starting position to an ending position with respect to said first elongated member as a result of the training exercise of the user when said apparatus is in use.

2. The training apparatus according to claim 1, wherein said engagement portion extends rearward and upward from said upper end of said first elongated member.

3. The training apparatus according to claim 2, wherein said angle is about 135 degrees.

4. The training apparatus according to claim 1, wherein said attachment point is substantially centered.

5. The training apparatus according to claim 1, wherein said weighted element is encased in rubber, plastic, leather, a cloth material, and any combination thereof.

6. The training apparatus according to claim 1, wherein said weighted element has a spherical shape.

7. The training apparatus according to claim 1, wherein said weighted element has a weight similar to a weight of an article desired to be thrown.

8. The training apparatus according to claim 1, wherein said first elongated member and said weighted element are substantially opposite one another when said flexible joining means is in said starting position.

9. An apparatus for training a throwing technique, said apparatus comprising:

a first elongated hollow member, said first elongated hollow member comprising a lower end, an upper end, and a body portion extending between said lower end and said upper end, wherein said first elongated hollow member further comprises an engagement portion extending rearward from said upper end of said first elongated hollow member, wherein said engagement portion, said upper end and said body portion define an elbow-like configuration and an angle, wherein the first elongated hollow member further comprises a placement means adapted for being positioned about an armpit of a user and held in place against a user's torso during use, wherein said placement means is a second elongated member adjustably secured to said first elongated hollow member, and wherein said placement means is generally perpendicular to a longitudinal axis of said first elongated hollow member;

a weighted element having an attachment point, wherein said weighted element is movable from a starting position to an ending position with respect to said first elongated member as a result of a training exercise of a user when said apparatus is in use; and a flexible joining means comprising a first end, a second end, and an intermediate portion extending between said first end and said second end, wherein said flexible joining means has a predetermined length, wherein said flexible joining means is secured about said upper end of said first elongated member by an adjustable securement means to adjustably secure said flexible joining means to said first elongated member while permitting said length of said flexible joining means to be varied as desired, wherein said adjustable securement means comprises an expansion fitting and a removably secured end cap, wherein said expansion fitting is adapted to fit securely inside said engagement portion and to adjustably secure said flexible joining means to said first elongated member while permitting said length of said flexible joining means to be varied as desired, and wherein said engagement portion engages with said first end of said flexible joining means; and wherein said removably secured end cap comprises a through-hole permitting said flexible joining means to pass through and into said first elongated hollow member and, wherein said flexible joining means is secured about said upper end of said first elongated hollow member, wherein said second end of said flexible joining means is secured at said attachment point of said weighted element, and wherein said flexible joining means is movable from a starting position to an ending position with respect to said first elongated hollow member as a result of the training exercise of the user when said apparatus is in use.

10. The training apparatus according to claim 9, wherein said engagement portion extends rearward and upward from said upper end of said first elongated member.

11. The training apparatus according to claim 9, wherein said angle is about 135 degrees.

12. The training apparatus according to claim 9, wherein said attachment point is substantially centered.

13. The training apparatus according to claim 9, wherein said weighted element is encased in rubber, plastic, leather, a cloth material, and any combination thereof.

14. The training apparatus according to claim 9, wherein said weighted element has a spherical shape.

15. The training apparatus according to claim 9, wherein said weighted element has a weight similar to a weight of an article desired to be thrown.

16. The training apparatus according to claim 9, wherein said first elongated member and said weighted element are substantially opposite one another when said flexible joining means is in said starting position.

17. An apparatus for training a throwing technique, said apparatus comprising:

a first elongated hollow member comprising a lower end, an upper end, a body portion extending between said lower end and said upper end, an engagement portion extending rearward from said upper end, and a longitudinal axis, wherein said engagement portion, said upper end and said body portion defining an elbow-like configuration and an angle with respect to said longitudinal axis;

a weighted element having an attachment point, wherein said weighted element is movable from a starting position to an ending position with respect to said first elongated member as a result of a training exercise of a user when said apparatus is in use; a flexible joining means comprising a first end, a second end, and an intermediate portion extending between said first end and said second end, wherein said flexible joining means has a predetermined length and wherein said flexible joining means is secured about said engagement portion of said first elongated hollow member by an adjustable securement means to adjustably secure said flexible joining means to said engagement portion while permitting said length of said flexible joining means to be varied as desired, wherein said adjustable securement means comprises an expansion fitting and a removably secured end cap, wherein said expansion fitting is adapted to fit securely inside said engagement portion and to adjustably secure said flexible joining means to said first elongated member while permitting said length of said flexible joining means to be varied as desired, and wherein said removably secured end cap comprises a through-hole permitting said flexible joining means to pass through and into said first elongated member, wherein said second end of said flexible joining means is secured at said attachment point of said weighted element, and wherein said flexible joining means is movable from a starting position to an ending position with respect to said first elongated member as a result of the training exercise of the user when said apparatus is in use;

and a placement means secured to said first elongated member, wherein said placement means is adapted for being positioned in an armpit of a user when in use.

18. The training apparatus according to claim 17, wherein said engagement portion extends rearward and upward from said upper end of said first elongated member.

19. The training apparatus according to claim 18, wherein said angle is about 135 degrees.

20. The training apparatus according to claim 17, wherein said attachment point is substantially centered.

21. The training apparatus according to claim 17, wherein said weighted element is encased in rubber, plastic, leather, a cloth material, and any combination thereof.

22. The training apparatus according to claim 17, wherein said weighted element has a spherical shape.

23. The training apparatus according to claim 17, wherein said weighted element has a weight similar to a weight of an article desired to be thrown.

24. The training apparatus according to claim 17, wherein said first elongated member and said weighted element are substantially opposite one another when said flexible joining means is in said starting position.

25. The training apparatus according to claim 17, wherein said placement means is a second elongated member adjustably secured to said first elongated member, and wherein said placement means is generally perpendicular to said longitudinal axis of said first elongated member.

* * * * *